US005502859A

United States Patent [19]

Kim

[11] Patent Number: 5,502,859

[45] Date of Patent: Apr. 2, 1996

[54] MULTI-DIRECTIONAL BRUSH

[76] Inventor: Wha J. Kim, 18600 E. Colima Rd. Apt. Q-104, Rowland Heights, Calif. 91748

[21] Appl. No.: 173,688

[22] Filed: Dec. 23, 1993

[51] Int. Cl.[6] ..... B25G 3/38

[52] U.S. Cl. ..... 15/144.1; 403/53

[58] Field of Search ..... 15/144.1, 144.2, 15/229.6; 403/53, 60, 78, 164; 248/179, 183, 178

[56] References Cited

U.S. PATENT DOCUMENTS

| | | | |
|---|---|---|---|
| 448,724 | 3/1891 | Myers | 15/144.1 |
| 824,479 | 6/1906 | Halvorsen | 248/179 |
| 855,152 | 5/1907 | Wilson | 15/144.1 |
| 2,432,058 | 12/1947 | Wilken et al. | 248/179 |
| 2,581,141 | 1/1952 | Raptis | 15/144.2 |
| 2,763,884 | 9/1956 | Fritz . | |
| 2,790,617 | 4/1957 | Harland | 248/183 |
| 2,948,910 | 8/1960 | Hulla . | |
| 3,205,522 | 9/1965 | Then | 403/53 |
| 3,214,778 | 11/1965 | Mathison . | |
| 4,020,520 | 5/1977 | Dellas . | |
| 4,249,817 | 2/1981 | Blau | 248/183 |
| 4,494,268 | 1/1985 | Chu . | |
| 4,715,080 | 12/1987 | Rydzicki . | |
| 4,751,762 | 6/1988 | Meimeteas . | |
| 4,882,802 | 11/1989 | Le Vere, Jr. . | |
| 5,123,138 | 6/1992 | Flamm . | |
| 5,207,755 | 5/1993 | Ampian | 15/144.2 |

FOREIGN PATENT DOCUMENTS

| | | | |
|---|---|---|---|
| 1122972 | 9/1956 | France | 15/144.1 |
| 35980 | 6/1886 | Germany | 15/144.1 |
| 2510150 | 5/1976 | Germany | 15/144.1 |

*Primary Examiner*—David A. Scherbel
*Assistant Examiner*—Tony G. Soohoo
*Attorney, Agent, or Firm*—Erik M. Arnhem

[57] ABSTRACT

A paint brush comprises tubular handle 12 and a device connecting the tubular handle 12 to the brush head. The tubular handle 12 is made of plastic material and the like with an opening 15 allowing extender to be inserted. The device has two locking systems, one connected to the tubular handle 12 and the other connected to the brush head. The device allows the angles and directions of the brush be adjustable. The brush head is equipped with a receiver to secure the device at the tip end of the ferrule of the head.

1 Claim, 3 Drawing Sheets

MULTI-DIRECTIONAL BRUSH

FIELD OF THE INVENTION

The present invention relates to a paint brush in general and, more specifically to a paint brush that adjusts its directions and angles to facilitate painting difficult and the hard-to-reach surfaces with ease. This present invention provides a device that adjusts the direction of the brush by the combined functions of turning and rotating the brush-connecting device to a desired position.

BACKGROUND OF THE INVENTION

With previously invented and known paint brushes, the normal method of painting is up and down or side-to-side. If the painter encounters surfaces with such angles that require painting by applying unconventional methods of painting strokes, the painter himself has to adjust into an unusual position to apply different directional strokes to paint the particular surface. Many times a painter encounters surfaces that are virtually impossible to reach, let alone paint with the prior art brushes. The deficiencies become such a burden that the painting operation is ineffective and much more difficult than it needs to be.

U.S. Pat. Nos. 4,751,762 to Meimeteas; 4,494,268 to Chu; 4,020,520 to Dellas; 3,214,778 to Mathison; 2,948,910 to Hulla; and 2,763,884 to Fritz show examples of a paint brush which is generally of one piece construction, with the brush-head, brush-neck, and handle rigidly interconnected. These prior art paint brushes are made in such a way as to only allow painting in directions in which the painter could hold and maintain the brush.

U.S. Pat. No. 4,15,080 to Rydzicki shows a paint brush attachment for holding a brush in different positions. This prior art attachment has to be connected and then disconnected every time it is used. The present invention provides a better construction and method in that the adjustable device is permanently located on the brush handle.

U.S. Pat. No. 4,882,802 to Le Vere, Jr. shows a broom having a broom handle that can be adjusted to adjust and control the length of bristle on each side. The present invention provides an improvement by allowing the head of the brush to turn around a longitudinal axis and also a transverse axis, whereby the bristles can reach areas that are normally inaccessible.

SUMMARY OF THE INVENTION

In accordance with this present invention, a paint brush is comprised of a handle having a longitudinal axis, a holder having a swivel connection to the handle, whereby the holder can be adjusted around a transverse axis normal to the handle axis, and a bristle assembly rotatably adjustable on the holder for adjustment around a third axis normal to said transverse axis. The paint brush is thereby adjustable in a multiplicity of directions or planes, to make the painting of hard-to-reach places easier, quicker, and less tiring.

Therefore, it is an object of this present invention to offer a solution to the deficiencies of previously invented brushes by making it easier to paint.

It is a further object of this present invention to provide professional and occasional or seasonal painters with a brush they can use to paint not only hard-to-reach surfaces, but also easy-to reach surfaces as well.

It is a further object of this present invention to provide paint brushes Wherein the painter can paint surfaces that ordinarily cannot be painted, due to unusual angles or directions of the brush stroke that would be required.

It is a further object of the present invention to provide a paint brush that can adjust and change its angles and directions to adapt to any given work surface and structural configuration.

It is a further object of the present invention to provide a paint brush which will make painting easier and faster for professional and occasional or seasonal painters.

BRIEF DESCRIPTION OF THE DRAWINGS

The present invention may be more readily described by reference to the accompanying drawing in which.

DESCRIPTION OF THE PREFERRED EMBODIMENTS

Figure 1:
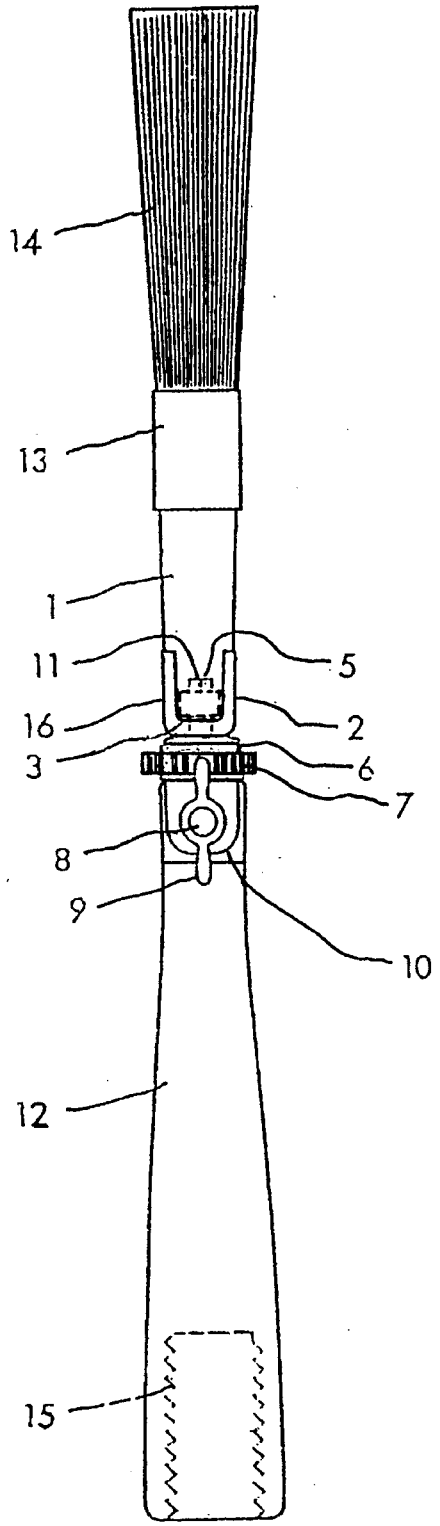
FIG. 1 is a side view of a paint brush-according to the present invention.
Figure 2:
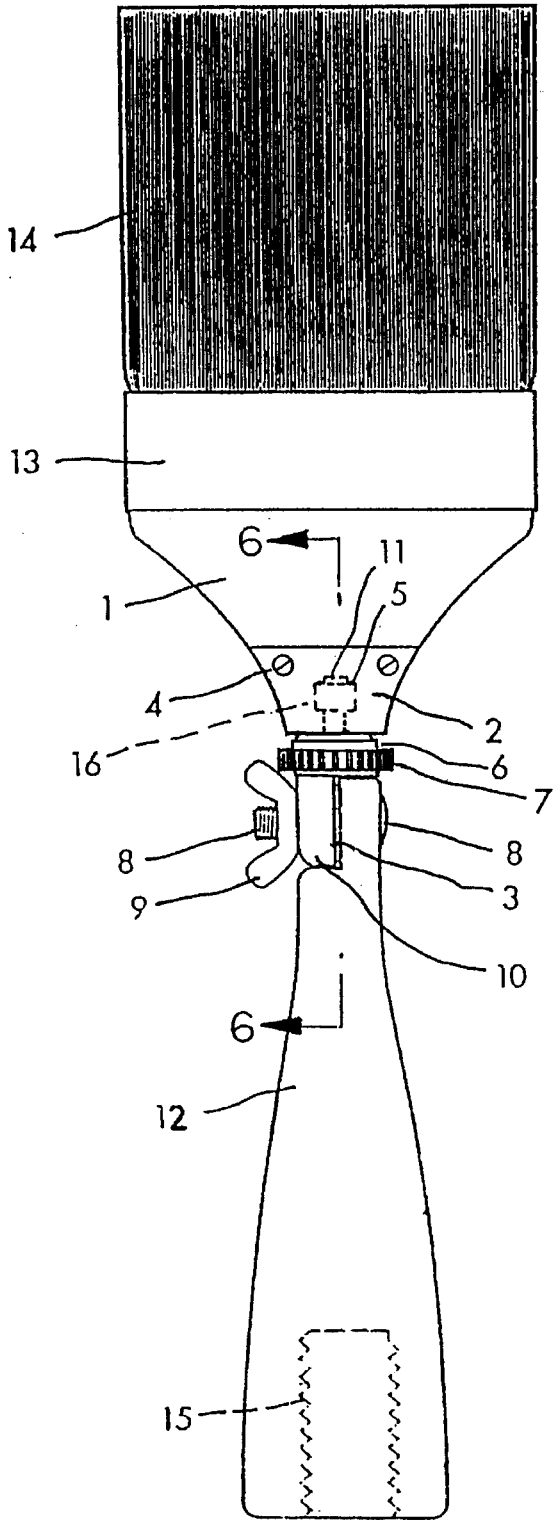
FIG. 2 is a frontal view of the FIG. 1 paint brush according to the present invention.
Figure 3:
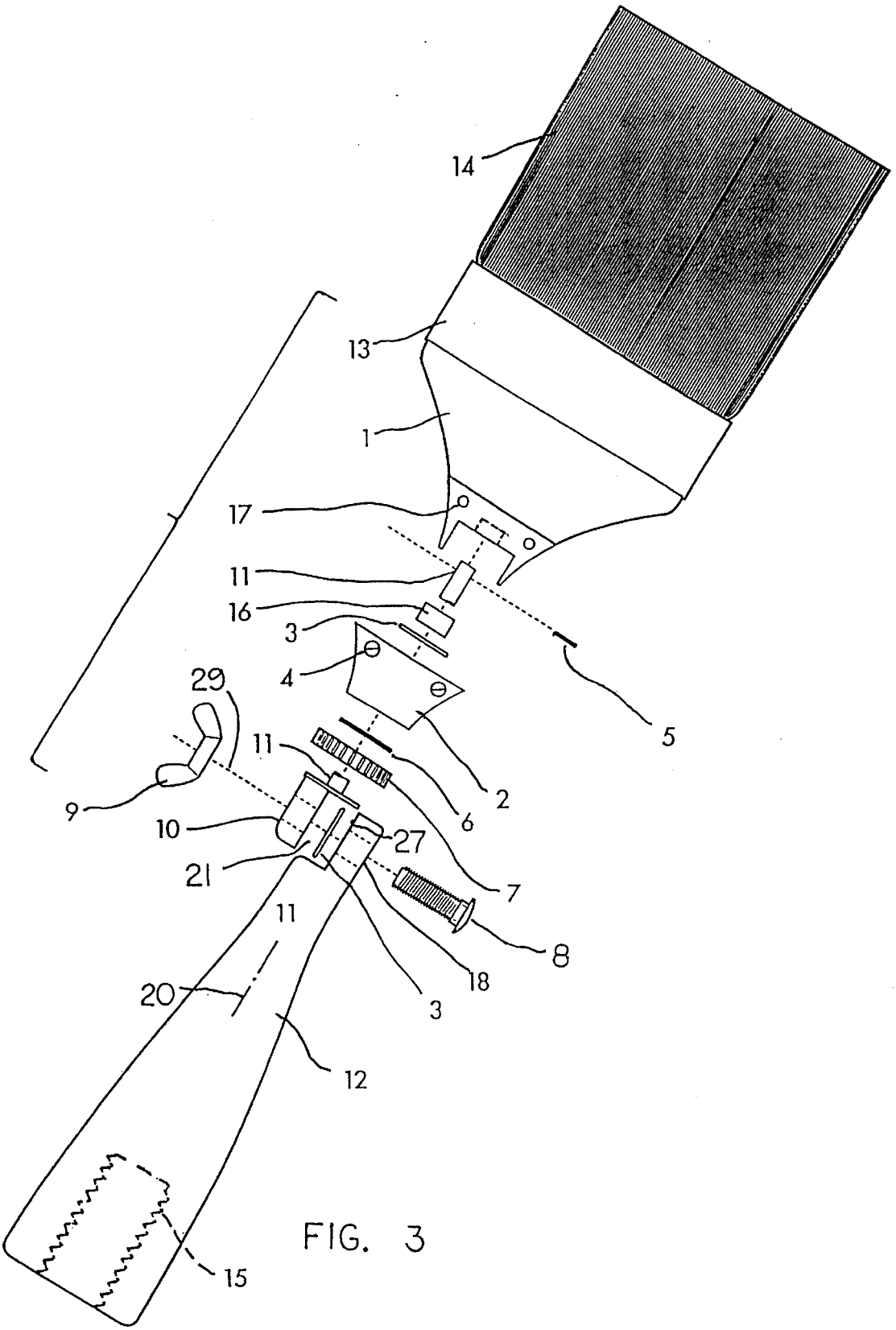
FIG. 3 is a perspective view broken away to show each component of the FIG. 1 paint brush.

Referring more particularly to the drawing by characters of reference, FIG. 1, FIG. 2, and FIG. 3 show the paint brush handle 12 having a hollow end 15. The hollow end 15 is made with a threaded screw hole that will allows brush-attaching extender to be inserted and secured to the handle. The handle is made of wood, plastic, rubber composition or other suitable materials. The handle is designed to have a wider transverse width in one direction, compared to the other direction, as shown on FIG. 1 and FIG. 2.

Handle 12 has a longitudinal axis 20 that coincides with a flat surface 27 formed By a recess 21 in the handle upper end.

Figure 4:
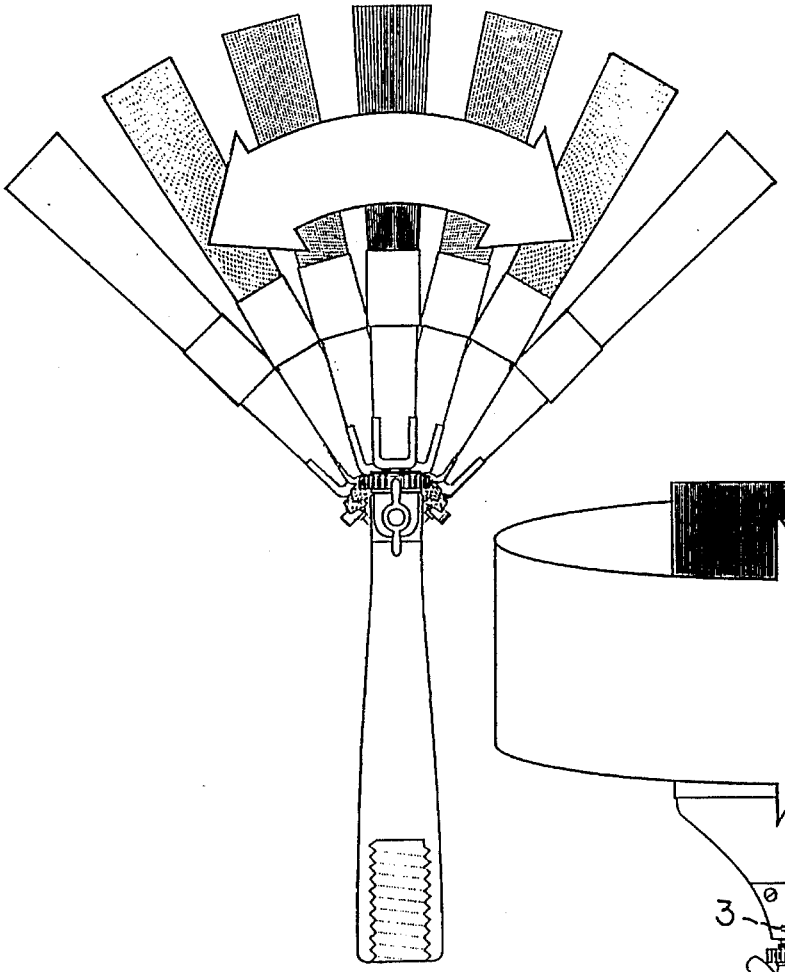
FIG. 4 is a side view of the paint brush according to the present invention, showing the adjusting movement of the brush from side to side, up to 90 degrees.

A relatively small holder 10 is swivably attached to handle 12 for rotational adjustment around a transverse axis, 29, i.e. an axis transverse to longitudinal axis 20. FIG. 4 illustrates the adjustability around axis 29.

Holder 10 comprises a circular disk 23, an arm 25 extending downwardly from disk. 23, and a circular pin 11 extending upwardly from the disk. Arm 25 is located in the aforementioned recess 21.

A screw 8 extends transversely through handle 12 near the handle upper end to define the aforementioned adjustment axis 29. Arm 25 has a hole therein formed to have a clearance fit on screw 8. A thumb nut 9 is threaded onto the screw for clamping holder 10 to handle 12; a first washer 3 can be positioned between arm 25 and flat surface 27 to improve the clamp action. Thumb nut 9 can be manually rotated to remove the clamp pressure, to thus permit the swivel adjustments depicted in FIG. 4.

A hollow U-shaped ferrule 2 has a web wall 31 formed with a circular hole adapted to receive pin 11, as shown in FIG. 2. An annular plug 16 and a second washer 3 are carried by the ferrule within the side walls 32. Transverse lock pin 5 extends through a small hole in pin 11 to retain plug 16 and washer 3 on pin 11. Plug 16 prevents the U-shaped ferrule 2 from being separated from pin 11, while permitting the ferrule to rotate around the pin 11 axis, as indicated by the circular arrow in FIG. 5.

Ferrule 2 serves as a mounting means for a paint brush bristle carrier 13 that supports the brush bristles 14. Carrier 13 has a neck 1 that extends downwardly into the space between ferrule side walls 32. Screws 4 are used to affix head 13 to ferrule.

Figure 5:
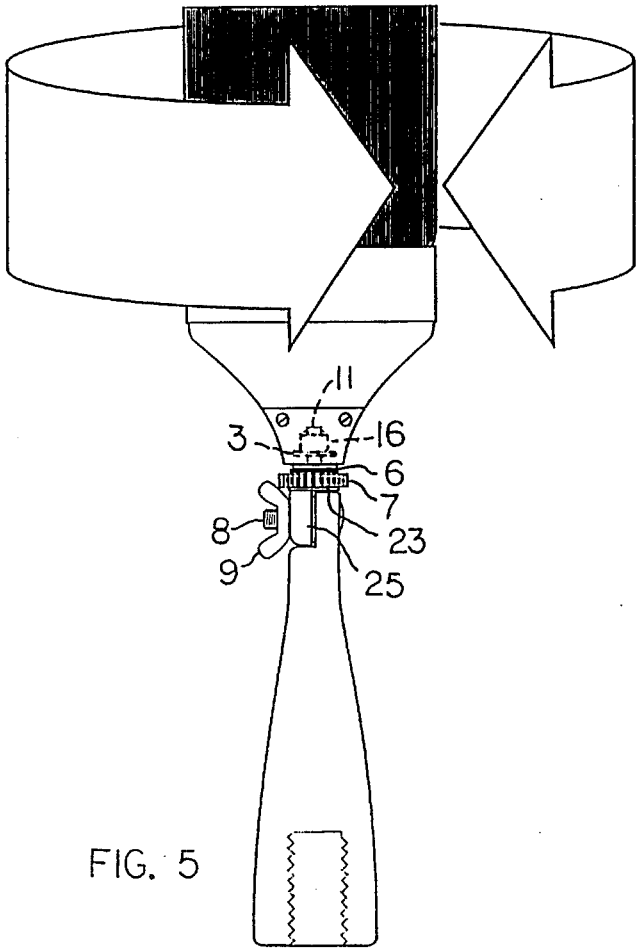
FIG. 5 is a front view of the paint brush according to the present invention, showing the rotational movement of the brush through a 360 degree arc.

Carrier 13, bristles 14, neck 1 and ferrule 2 collectively define a brush head assembly. As shown in FIGS. 2 and 3, an annular turner 7 is carried on pin 11 in the space between an annular cushion 6 and disk 23. Turner 7 can be turned on pin 11 to loosen the brush head assembly, which will allow rotation of the brush head assembly, as shown in FIG. 5. Once the brush head assembly is in a desired position of rotational adjustment the turner 7 can be turned in the tightening direction to hold the brush head assembly in an operable position.

I claim:

1. An adjustable paint brush comprising a handle (12) having a longitudinal axis: said handle having one end thereof cut away to form a recess (21):

a holder (10) comprising a disk (23), an arm (25) extending from said disk in one direction, and a circular pin (11) extending from said disk in an opposite direction, said arm being located in said recess, and said disk being located beyond said one end of said handle.

a screw (8) extending transversely through said handle and said arm on an axis normal to the handle longitudinal axis, a thumb nut (9) threaded onto said screw for clamping said arm to said handle;

said arm having a clearance fit on said screw, whereby when the thumb nut is loosened said holder can be rotatably adjusted around the screw axis;

a brush head assembly that comprises a bristle carrier (13), bristles (14), neck (1) and a U-shaped ferrule (2) secured to said neck;

said U-shaped ferrule (2) having a web wall, and a circular hole in said web wall so that said pin extends freely through said hole into the ferrule; an annular plug (16) carried by said pin within said ferrule so that the brush head assembly is rotatable on said pin, and the plug retains the brush head assembly on said holder;

said brush head assembly being rotatably adjustable around the pin axis, whereby said bristles can conform to unusual angles of work surfaces that are to be painted.

* * * * *